US007077348B2

(12) United States Patent
Johnson et al.

(10) Patent No.: US 7,077,348 B2
(45) Date of Patent: Jul. 18, 2006

(54) VERTICAL SHAFT IMPACTOR WITH SUSPENDED IMPELLER

(76) Inventors: Louis Wein Johnson, 345 Palomino Dr., Eugene, OR (US) 97401; Bruce G. Johnson, 26710 Alpine Cutoff Rd., Monroe, OR (US) 97456

( * ) Notice: Subject to any disclaimer, the term of this patent is extended or adjusted under 35 U.S.C. 154(b) by 50 days.

(21) Appl. No.: 10/623,942

(22) Filed: Jul. 22, 2003

(65) Prior Publication Data

US 2005/0017110 A1 Jan. 27, 2005

(51) Int. Cl.
*B02C 19/11* (2006.01)
*B02C 19/00* (2006.01)

(52) U.S. Cl. ..... 241/275; 241/85

(58) Field of Classification Search ..... 241/275, 241/81

See application file for complete search history.

(56) References Cited

U.S. PATENT DOCUMENTS 3,970,257 A * 7/1976 MacDonald et al. ..... 241/275
4,579,290 A * 4/1986 Terrenzio ..... 241/275
5,145,118 A * 9/1992 Canada ..... 241/275
6,070,820 A * 6/2000 Young et al. ..... 241/275
6,416,000 B1 * 7/2002 Lusty et al. ..... 241/275

* cited by examiner

*Primary Examiner*—Derris H. Banks
*Assistant Examiner*—Jason Y. Pahng

(57) ABSTRACT

A vertical shaft impact crusher having an upright main frame; a hollow shaft journalled within and suspended by an antifriction bearing supported by a flexible supported housing; an impeller attached to said hollow shaft similar to gun lock means. A second frame within said main frame is elevated and lowered hydraulically and supports an annular rock chamber. Power means to rotate said hollow shaft. Hydraulic means to tighten drive belts from power means to shaft and to relax said belts; Hoppers above and below said shaft and impeller. A static tube within said hollow shaft delivers rock into impeller which propels rock at very high speeds; rocks are shattered by impact of rock against rock resulting in a finely crushed product; all crushing is contained within said chamber. Product falls into lower hopper and is conveyed away.

7 Claims, 14 Drawing Sheets

102
115
117
41
58
73
51
22
60
204
117
117
121
118
119
117

121
117
117

48
120
118
102
121
117
116
120
121
115
41
21

60
210
200
204
212
211
217
203
201
215
206
64
65
66
68
67
213
202
207
209
208
θ
63
69

73
51
231
232
227
228
A'
226
215
225
228

229
77
180
181
77
230
VIEW THRU A-A'
229
230
A
73
194
51
180
73
197
224
58
215
57
200

VERTICAL SHAFT IMPACTOR WITH SUSPENDED IMPELLER

BACKGROUND OF THE INVENTION

This invention relates to rock and ore crushers, and more particularly to crushers of the vertical shaft impactor type which are arrange to direct rock and ore material onto a rapidly rotating impeller structure that expels the material outwardly at high speed for shattering impact of the expelled rock and ore material within the crusher into smaller fragments and fines which are discharged from the crusher as desired, crushed product.

Next to food, clothing, and shelter, rock in useable form is the most important product of advanced society. It is essential for building homes, roads, buildings, dams, airports, railroads, and other uses for human benefits. Rock in gravel form where deposited is less costly to process than quarry rock, but in either form it rarely can it be used as found, consequently it must be reduced to required sizes; in some third world countries rock is manually crushed with hammers where one person might produce a ton of rock per day of rock in sizes mostly too large for best usage. In modern societies rock is crushed in enormous volumes by machinery and few workers. Rock crushers are normally used in three or more sequential stages: First a compression type primaries either jaw or gyratory for large size rock, second stage usually gyrating cone type for reducing oversize rock from the first stage to the larger useable sizes, and tertiary stage for the smallest but very essential sizes. It is very difficult to produce fine crushed rock with compression type crushers; the stresses are very high and volume is low and the wear rate of wear liners is costly.

Since the mid twentieth century a form of crusher called a "VSI" in the trade, an acronym for Vertical Shaft Impactor, was invented; it uses a high speed impeller mounted on the top end of a vertical shaft. It throws the rock against metal anvils. Many different manufacturers have brought this concept to market, but the extremely high costs of maintenance both in parts and frequent need of labor to change impeller slingers and anvils has been a bane to their success. There is another design of VSI that crushes rock on rock which eliminates anvils and their high costs, but it has less crushing efficiency and higher power demand per ton of net product; it uses essentially the same mechanics as does the anvil design except the rock chamber. The design in this patent application is a new concept of the mechanics of rock on rock crushing; it is substantially easier and faster to service and reduces the costs of fine crushing to be very acceptable.

BRIEF SUMMARY OF THE INVENTION

In its basic concept this invention provides a suspended impeller rock and ore crusher apparatus arranged to support an impeller member on the bottom end of a hollow, rotating drive spindle, open through its opposite ends, and supported by a bearing assembly in vertically suspended condition by the crusher main frame, for passage of rock and ore material to be crushed from a feed hopper, through the hollow interior of the spindle and to the impeller, whereupon the material is ejected at high speed from the rotating impeller and into shattering impact within an encircling annular rock impact chamber, the chamber preferably being supported on the main frame for vertical movement between an operative, impeller-encircling position and a maintenance position in which the chamber is moved vertically out of impeller-encircling position for facilitated inspection, servicing and replacement by maintenance personnel.

Another object and advantage of this invention is the provision of a crusher apparatus of the class described in which the impeller-supporting drive spindle support bearing is a single antifriction bearing assembly contained in an enclosure providing a sealing arrangement to exclude contaminants and retain lubricants, and is supported on the main frame to absorb vibration and unbalancing forces from the rotating spindle and impeller supported thereon.

Another object and advantage of this invention is the provision of a crusher apparatus of the class described having a protective, hollow static tube extending through the hollow interior of the rotating spindle member for communicating rock and ore through the hollow interior of the spindle member while preventing damaging contact of the material with the interior surfaces of the rotating spindle member.

A further object of this invention is the provision of a crusher apparatus of the class described having a spindle drive arrangement utilizing a pair of opposed, motor-driven, spindle-engaging belt drives engaging the spindle above and below its bearing mount, the belts being selectively tensioned to assure against binding forces between the rotating spindle and supporting bearing.

A further object and advantage of this invention is the provision of a crusher apparatus of the class described which may include a swingable maintenance boom apparatus on the main frame for supporting and moving impeller members being changed during maintenance operations.

A still further object and advantage of this invention is the provision of a crusher apparatus of the class described which is of simplified construction for economical manufacture and maintenance.

The foregoing and other objects and advantages of this invention will appear from the following detailed description, taken in connection with the accompanying drawings of a preferred embodiment.

BRIEF DESCRIPTION OF THE DRAWINGS

FIG. 13 is a plan view of a containment and wear protector ring.

FIG. 15 is an exploded vertical sectional view of a wedging arrangement.

FIG. 16 is a vertical sectional view of the parts of FIG. 15 in fully assembled condition as would be viewed from the right in FIG. 15.

DETAILED DESCRIPTION OF THE INVENTION

Figure 1:
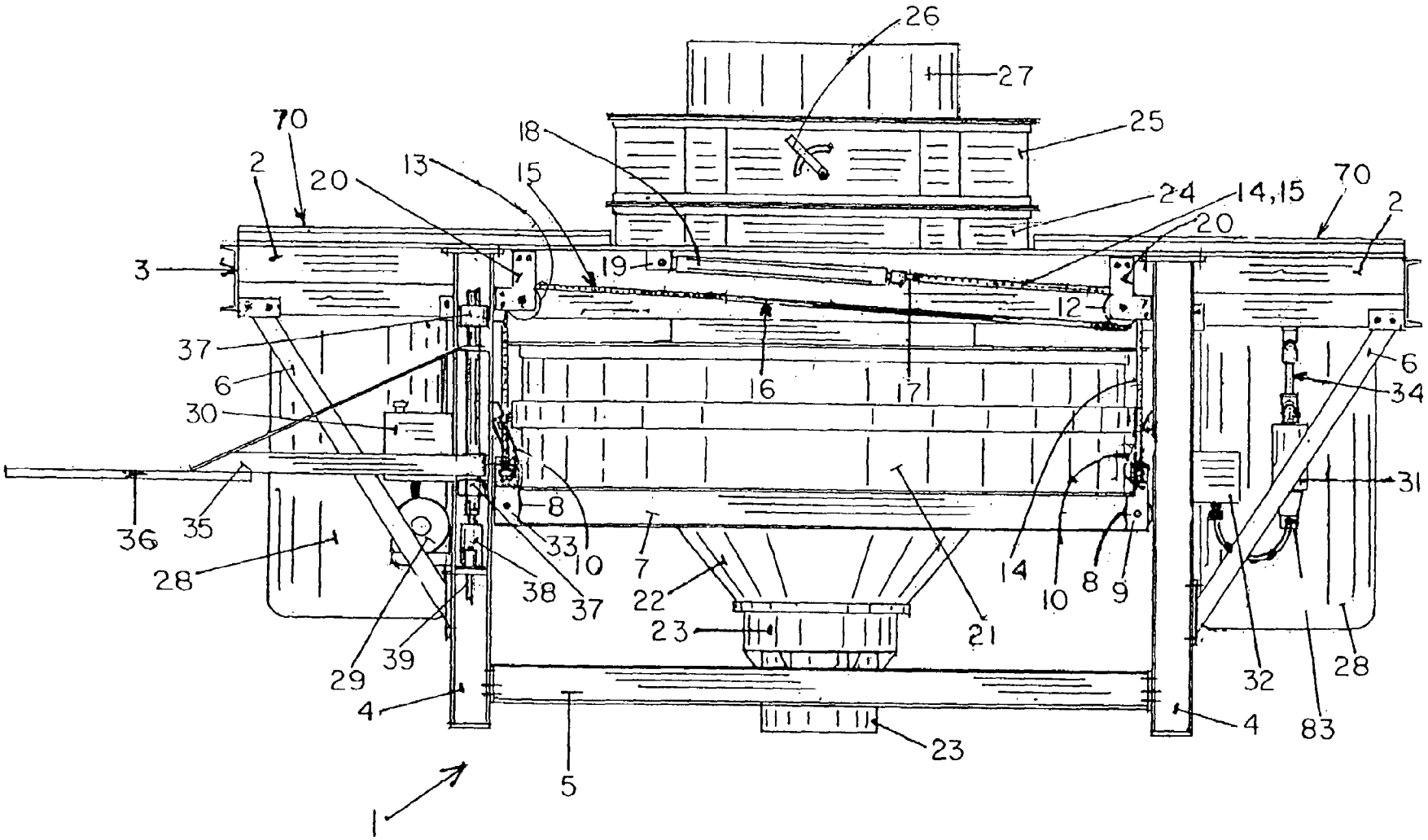
FIG. 1 is a vertical side elevational view of a crusher embodying features of this invention.

In FIG. 1, the full side view of a complete machine 1 is represented, the opposite side being virtually identical. Beam 2 is one of two longitudinal main frame beams each composed by having two unequal leg angle irons joined by welds to form a stepped 90° Z. Cross beams 3 are at each end of beams 2 and space said beams 2 apart a designed distance. Not shown are X bracing of vertical columns 4 90° to beams 2. Horizontal beams 5 space columns 4 to parallelism and with angle braces 6 provide a very stiff structure.

Beam 7 is one of two parallel beams joined at their ends by channel beams 130 that forms a frame herein referred to as an elevator. When the elevator is in working position four hooks 10 hold it from dropping. Two sets of roller chains 14 and 15 connect to equalizer means 17 which connects to the cylinder rod of hydraulic cylinder 18 which is anchored at bracket 19. Both chains 14 engage the teeth of inner sprocket 12 less than 90° and connect to said elevator at brackets 145, and both chains 15 wrap the outer sprockets 12 180° and connect to rod 16.

Two second sections of chains 15 connect to the other end of rod 16 and roll over sprockets 13 and connect to adjustment means in bracket 33. The length of rod 16 is the distance between sprockets 12 and 13 minus the stroke of cylinder 18 minus enough chain links to avoid contacting either sprocket; double sprockets 12 and single sprockets 13.

Brackets 20 support sprockets 12 and 13, and an annular chamber 21 is open at top and partially open at bottom for crushed product to exit into and through conical chamber 22 and telescoping extension 23. Two risers 24 support hopper 25 above a belt drive system; both risers 24 have passage ways to bypass material to be crushed and passage ways for air recirculation. Lever 26 controls an air damper vane and is lockable through 90°; A hopper extension 27 is usually supplied by the customer.

Drive motors 28 are opposed 180°; a motor pump unit 29 provides hydraulic power as needed, and Has oil reservoir 30. Lube oil motor pump 31 is directly connected to pump 83 which prelubricates an antifriction bearing before motors 28 are started. An overrunning clutch mounted on pump motor's top shaft extension allows the pump motor to run before motors 28 start. Because drive shaft assembly 34 is driven by one motor after that motor is at full speed and powers lube pump through the lube motor's shaft, the overrunning clutch locks-up, and power to the lube motor is shut off. Oil returns to oil reservoir 32 in a closed circuit; the oil is filtered. A special grade of oil is required because of the high bearing speed imposed. A swinging boom 35 having a cradle 36 is used to exchange an impeller 60, (FIG. 2), and a hydraulic jack 38 lifts and lowers said boom vertically; bracket 39 supports said jack. Light weight covers 70 span the width of the main frame shielding all moving parts from inclement weather.

Figure 2:
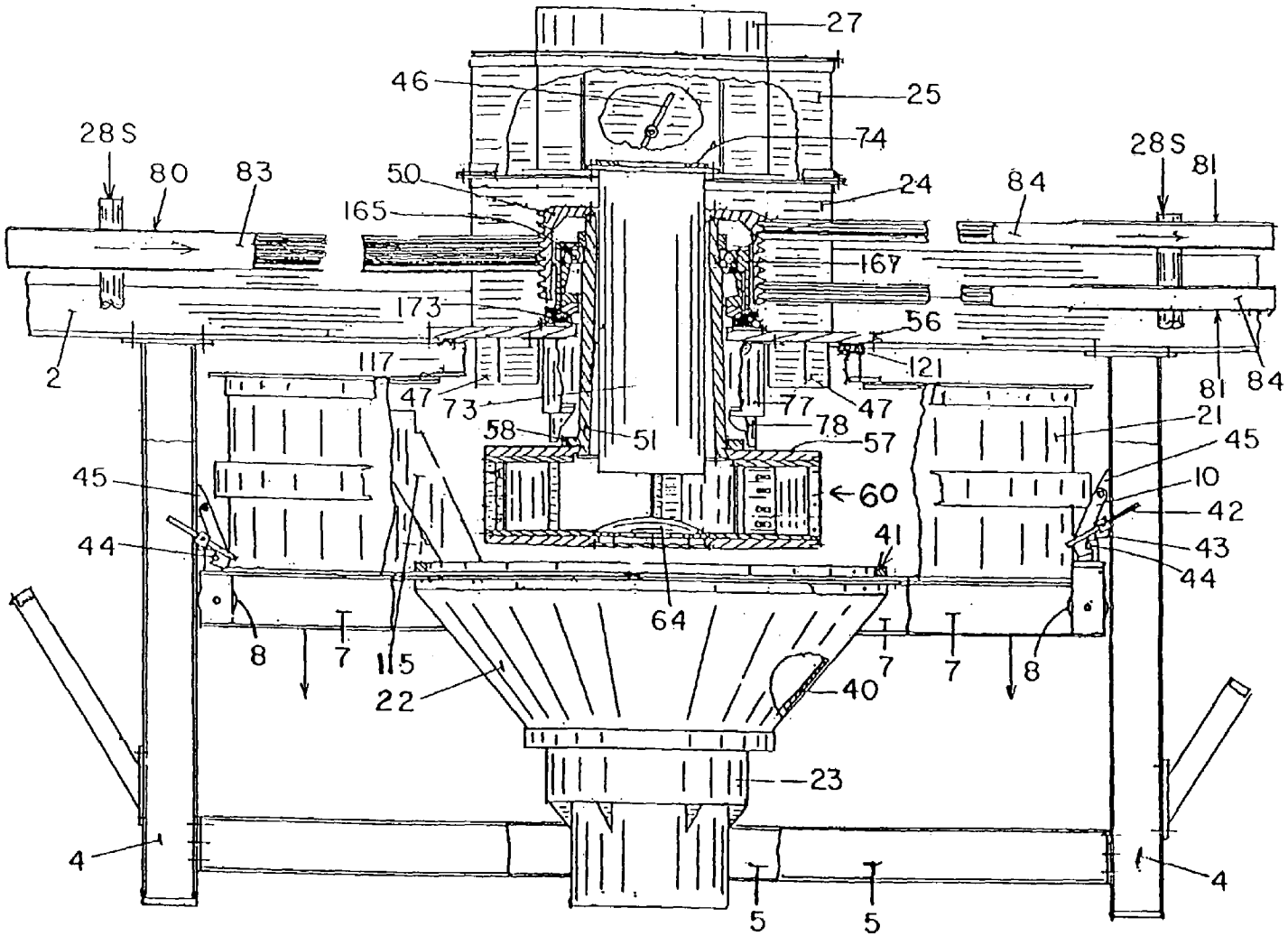
FIG. 2 is a side elevation generally similar to FIG. 1 but with parts being broken away to show internal detail hidden from view in FIG. 1.
Figure 19:
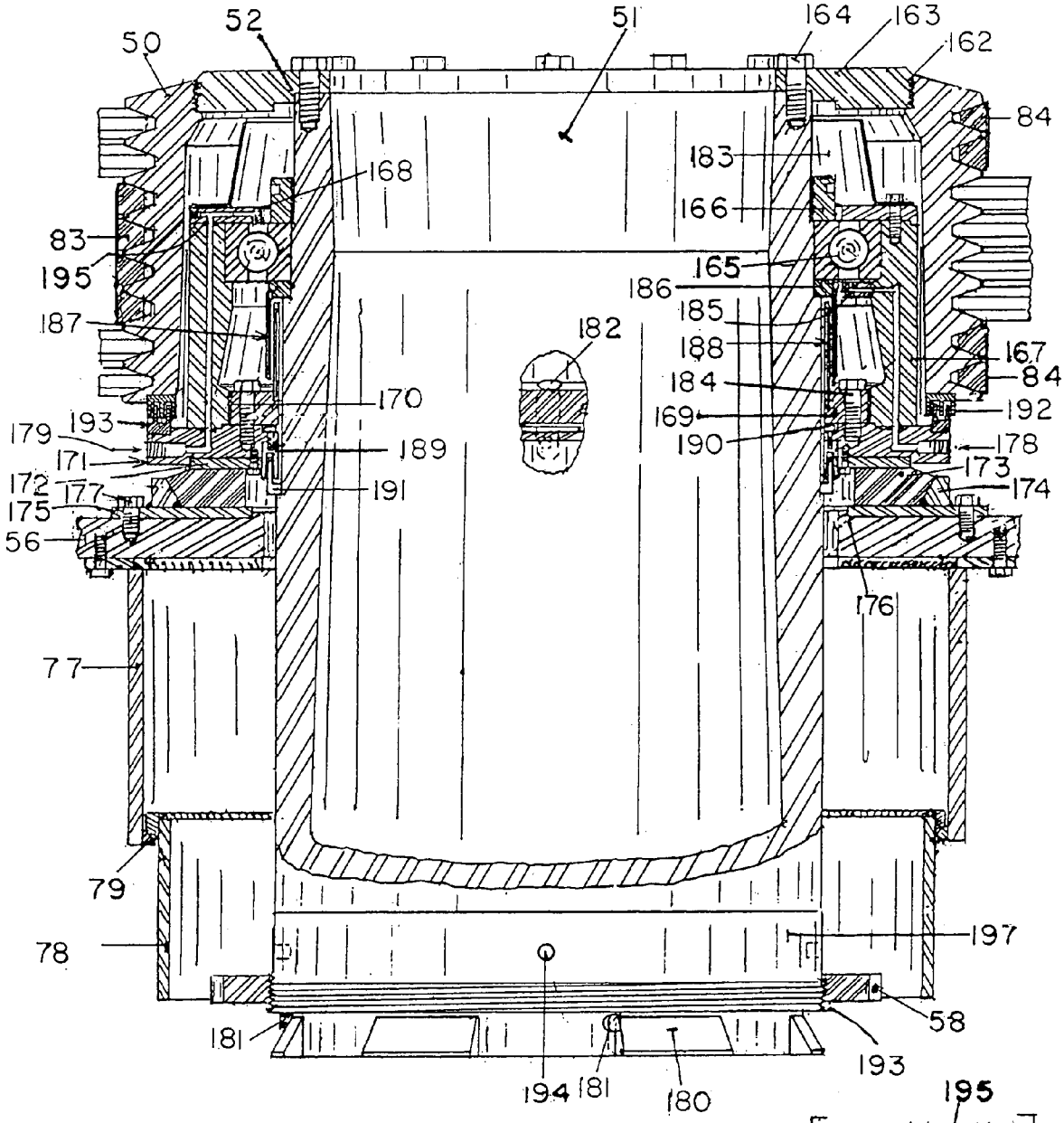
FIG. 19 is a vertical sectioned view of the main rotating parts of the crusher of this invention.

FIG. 2 is a fragmented view showing the main rotating parts sectioned through their center of rotation. Sheaves 80 and 81 on their respective motorshafts 28S are vee belted to driven sheave 50. Belt 83 is a multistrand belt centered over ball bearing 165, and twin belts 84 each have one half as many strands as straddle 83. This design eliminates any bending or tilting forces on bearing 165 caused by belt tension or motor torque pulling. Detailed construction of this design is shown in FIG. 19.

Sheave 50 is attached to hollow spindle 51 with multiple cap screws, and spindle 51 is journaled in bearing 165 which in turn is contained in housing 167. Base plate 56 supports housing 167 through a flexible ring 173, and an impeller or rotor 60 is attached to said spindle by a quick attach and release gun lock design in which a large nut 58 forces and retains a secure coupling of the gun lock. This nut has gear teeth around its circumference to enable one person to tighten the nut to required torque.

Rock or ore to be crushed is conveyed to hopper 27 where it falls onto choke ring 74 and down stationary tube 73 into impeller 60 which has spinning speeds sufficient to break both ejected rock and other rocks that are in suspension previously ejected or that have fallen through bypass chutes 47. Chamber 21 contains a bed of static rock or ore sloping from wear ring 41 upward and outward at whatever angle of repose is taken. Multiple vanes 115 form compartments and support a containment ring detailed on Page 6 of the drawings.

An extremely violent activity occurs within the rock chamber as the energy of several hundred horsepower is converted to accelerating a stream of rock or ore to over 250 feet per second, with broken rock and dust swirling in a tornado of abrasive atmosphere. To protect expensive parts we provide low cost protective means: The top surface of impeller 60 is protected by disc 57, and spindle 51 and gear nut 58 are protected by static annular members 77 and 78. The member 78 telescopes into annular member 77 when access to nut 58 is necessary to change impellers, and the perimeter edges of the impeller are protected by welds of abrasion resistant metal.

Plate 64 serves as both an impact and distributor plate and can be of several different shapes of its top surface. A rectangle of angle iron 117 extends upward above chamber 21 and is bolted to the top flange of chamber 21. A commercial channel rubber 121 snaps over the upstanding edges of angle iron 117 and seals against the underside of plate 56. Hooks 10 are pinned to brackets 45, and latching pins 44 are provided for the hooks, and cams 43 are keyed to cross shafts and bear against each hook. Tee handles 42 provide manual leverage to turn all cams from one side of the machine. When elevator 7 is to be lowered a slight upward lift is made to release its weight on the hooks. Elastomer 121 yields enough to permit releasing said hooks, and levers 42 are turned to force cams to push hooks clear of pins 44, which allows the elevator to be lowered by gravity. Hooks are shaped to automatically latch over pins 44 when elevator is raised to working position. Replaceable wear liners 40 protect conical hopper 22.

Figures 3, 4, 5:
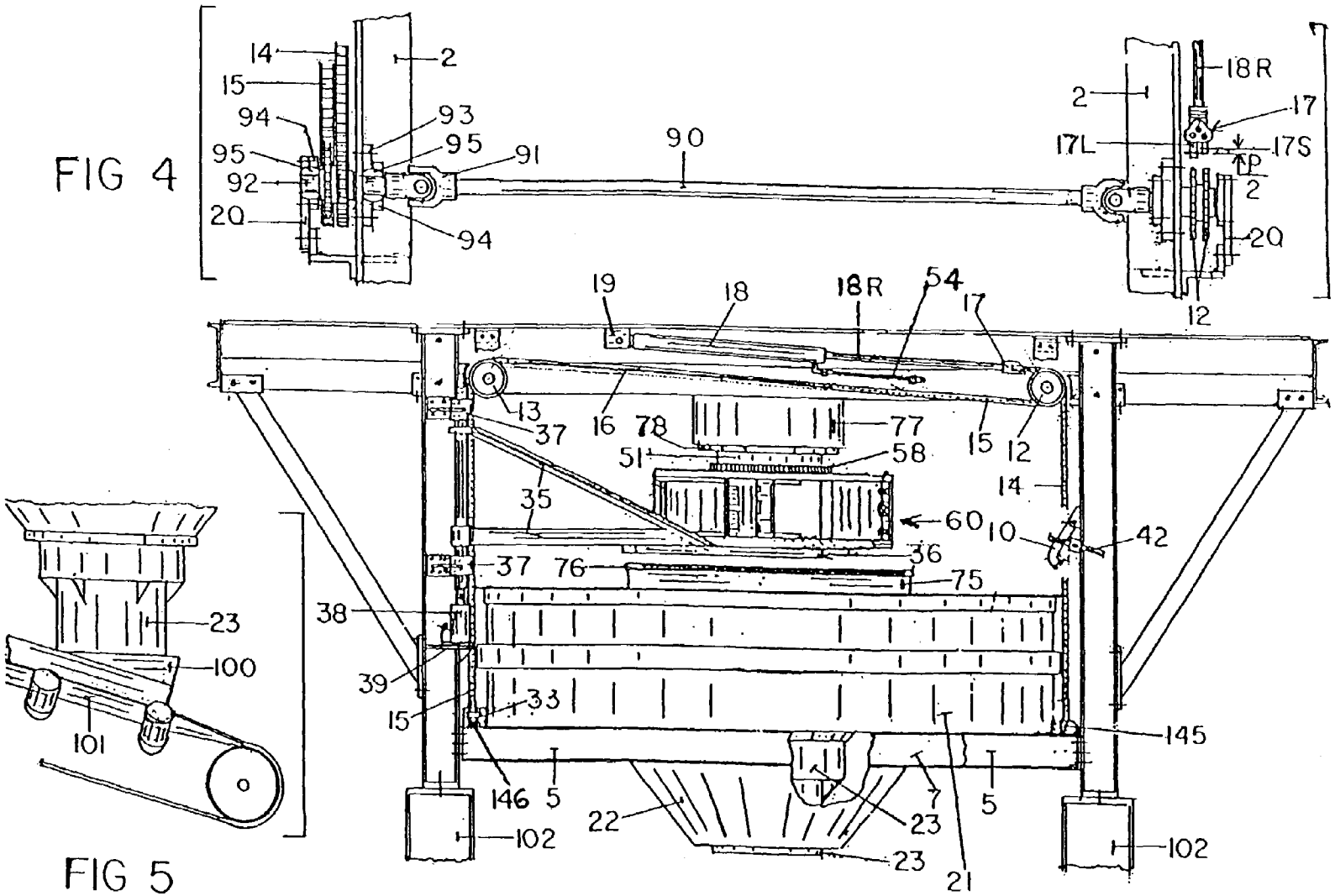
FIG. 3 is a side elevation of the annular chamber and impeller structure of FIG. 2 but with the annular chamber shown in its lowered, maintenance position.
FIG. 4 is a fragmentary plan view of an arrangement to insure even raising and lowering of elevator frame 7.
FIG. 5 is a fragmentary side elevation of a discharge apparatus for receiving crushed product from the annular chamber and transporting it for additional processing.

FIG. 3 shows the elevator in down position with chamber 21 resting on beams 5, and extension 23 telescoped into hopper 22. Two identically mounted hydraulic pull cylinders 18 are connected in parallel by hydraulic hoses 54 and then to a control valve not shown. Anchor bracket 19 is shown on extended cylinder rod 18R. The swing boom 35 is positioned for its cradle 36 to receive impeller 60. A jack 38 either hydraulic or mechanical raises or lowers the boom as its pivot shaft slides in bearing brackets 37, and nut 58 is unscrewed just enough to free the gun lock. Jack 38 raises the impeller just enough to allow manual turning of spindle 51 to where the gun lock will allow separation of the impeller from the spindle. Then the boom with impeller is lowered and swung outward to a position that will allow exchanging for another impeller.

FIG. 4 is a plan view of the means to insure even and controlled lifting and lowering of the elevator. Timing shaft 90 has universal joints 91 coupled to short shafts 92 which are journaled in self aligning bearings 95 contained in two piece spherical housings 93 and 94 at inside position and brackets 20 and the same caps 94 at the outside. Dual sprockets 12 are keyed to shafts 92 and are staggered one half their tooth pitch as a preferred option, but it is not necessary to stagger. Equalizer link 17 is a means to equalize chain loading. Chains 17L and 17S connect equalizer means 17 to each chain and their length difference is one half the chain pitch. Chains 14 roll over the inner sprockets then descend directly to brackets 145. Chains 15 make a 180° turn around the outer sprockets and connect to rods 16, and second sections of chains 15 join to rods 16 and to adjustable anchors 146. Rods 16 are used to make chain lengths as short as possible because chains tend to stretch and hang in a sagging curve that affects their lengths adversely, and would making an even lift of the elevator very difficult. The mechanics of both sides are identical.

FIG. 5 shows the need for member 23 to telescope into chamber 22, because conveyer 101 and hopper 100 are immovable and to permit the elevator assembly to be lowered. We choose this way to accommodate elevator lowering. Vertical shaft crushers generate considerable dust which must be contained, and this is best done by air vacuum drawing off dust from a conveyor belt hopper a short distance beyond where member 23 joins with the hopper 100 which is enclosed except where the conveyor 101 carries crushed products beyond hopper 100. The dust laden air is cleaned in bag houses.

Figures 6, 7:
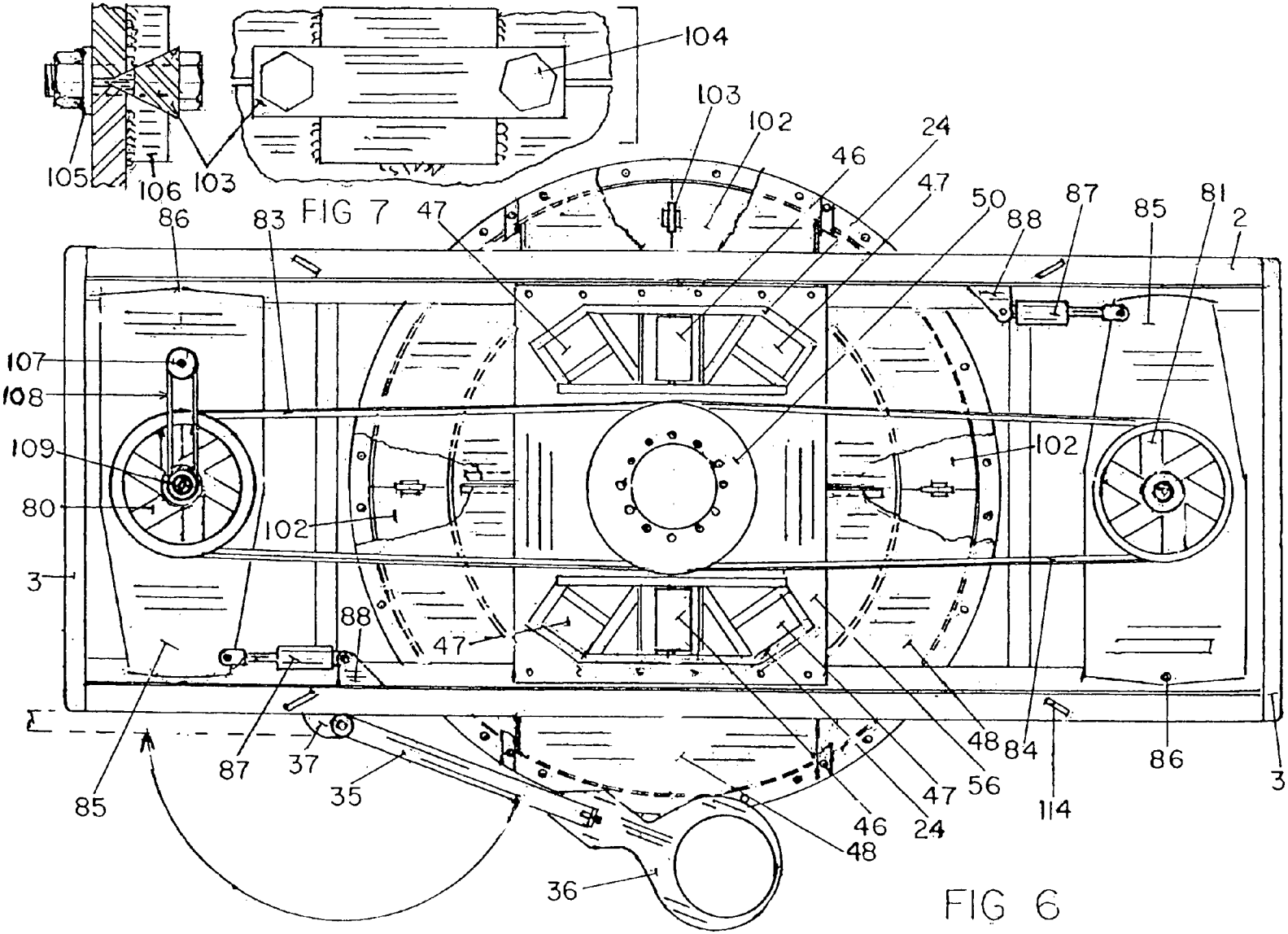
FIG. 6 is a plan view of the top of the crusher with the top hopper removed, parts being broken away to show internal detail otherwise hidden from view.
FIG. 7 is a fragmentary sectional view of a wedging arrangement.

FIG. 6 is a plan view of a complete machine less motors, top hoppers 25 and 27 and covers 70. Main power motors 28 are suspended from steel plates 85, which pivot at pivots 86 and are stabilized and supported level by two supporting roller assemblies opposite to the pivot, and two screw adjusted pads near the edges of plate 85 and slightly offset to pivot 86, (as detailed on page 13 of the drawings). Push-pull hydraulic cylinders 87 anchored at bracket 88 are connected in parallel with hydraulic hoses and to a control valve which is supplied by pressurized oil from pump means 29, shown in FIG. 1. This system tensions belts 83 and 84 in the push mode to proper tension by an adjustable relief valve and bases can be pulled to release tension at down time to increase belt life and give ample slack to facilitate easy belt replacement.

Supports 24 raise hopper 25 above sheave 50 to provide top and side clearances for changing belts over sheave 50. When vee belts are changed it is necessary to remove feed tube 73. Bypass chutes 47 increase crushing efficiency and capacity and confine overflow within the machine. Damper valves 46 can be used to control the circulating air that passes through the impeller along with material to be crushed by impact. Air volume varies inversely with volume of material passing through ring 74 FIG. 2, and recirculating the air reduces its outflow through hopper 23. The tilt of valve 46 is controlled by exterior lever 26.

An expandable sectioned containment ring 102 prevents turbulent crushed rock from impinging against the mild steel cover plates 48. Sections of ring 102 are expanded by wedges 103 detailed in FIG. 7. Pulley 107 is mounted on a shaft journalled in a bearing housing 110, FIG. 33, and coupled to shaft 34 by a universal joint FIG. 1. A vee belt 108 driven by pulley 109 mounted on motor shaft 28S drives pulley 107; said bearing housing is slidable for belt adjustment. When the main motors reach full speed one motor drives the lube oil pump 83 through motor shaft of pump 31, and power to the pump 31 is shut off. This system prevents stoppage of lube oil to bearing 165 by electric power failure. Coasting time of main motors and spindle after power is cut off is several minutes, and this design insures the ball bearing would not be destroyed by lack of lubricant.

FIG. 7 shows one of several elongated wedges 103 forced between buttress members 106 by bolts 104 to expand segments of ring 102 to tightly fit the annular wall of chamber 21. Plates 105 partially cover the gaps between sectors of ring 102 and bolt nuts are tack welded to plates 105 because the nuts are not very accessible for a wrench. Lifting attachment 114 is one of four lifting attachments.

Figures 8, 9, 10, 11, 12:
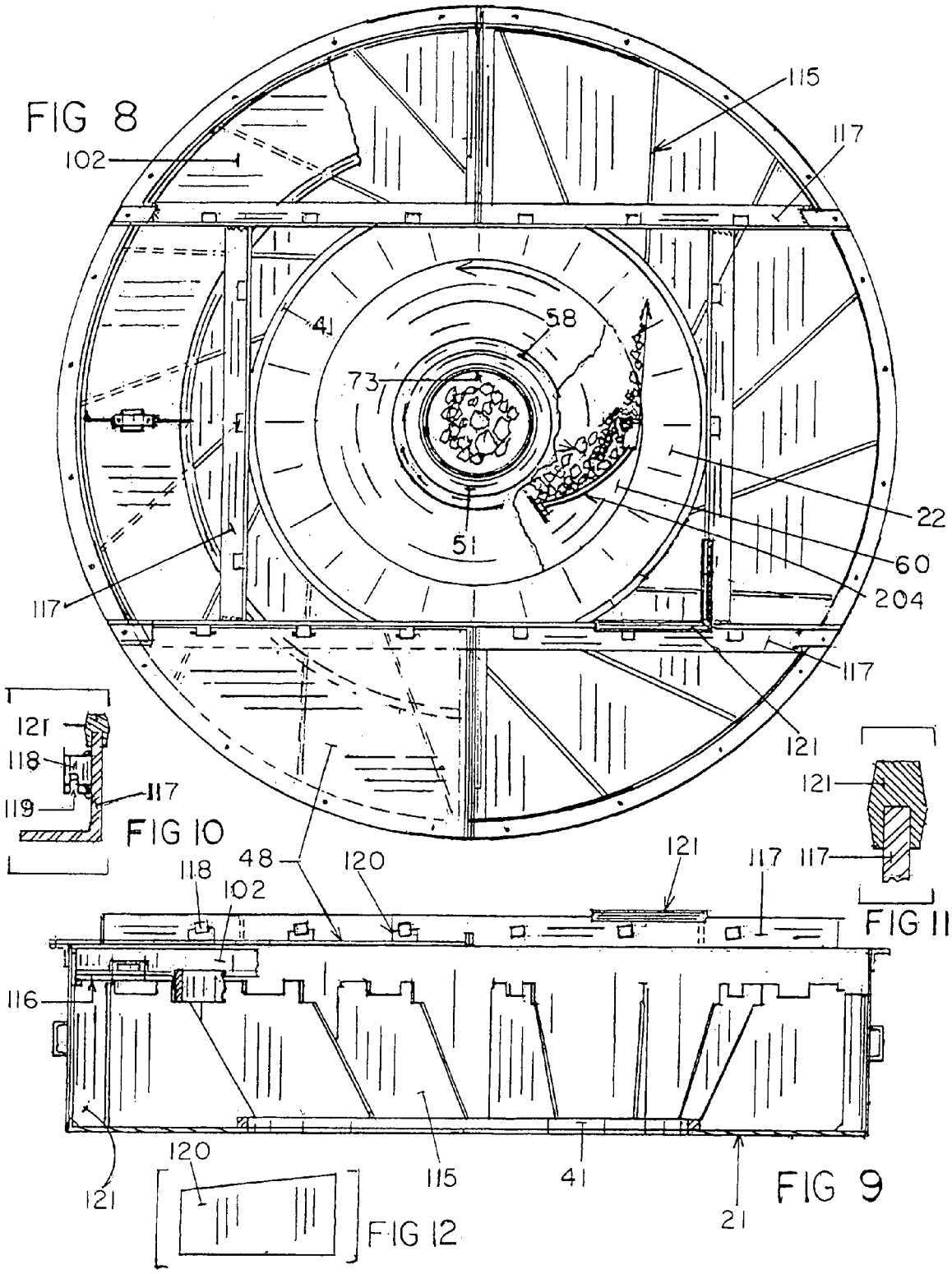
FIG. 8 is a plan view of the annular chamber partially sectioned and showing a simulated propelling of rock.
FIG. 9 is a vertically sectioned view of the annular rock chamber.
FIG. 10 is an enlarged end view of a wedging buttress.
FIG. 11 is an enlarged sectioned view of an elastomer seal seated on a steel support.
FIG. 12 is a side elevational view of a wedge.

FIG. 8 is a plan view of the rock chamber 21. Multiple vanes 115 are set approximately tangent to the rim of the impeller 60. Nut 58 is a geared nut, and tube 73 is the stationery down tube through which crushable material drops. A simulation is shown of rock falling through tube 73 and flowing outward against a static a layer of rock retained by arcuated walls 204; the flowing rock rolls toward and over carbide tips where it leaves the impeller at very fast speeds. As the bed of rock rolls toward the tip it is subjected to several Gs of pressure which causes considerable rock on rock crushing and abrasion before the rock leaves the impeller.

Rectangular frame 117 supports the inner edges of cover plates 48 with a wedging system. FIG. 10 shows buttress blocks 118 having channels 119 to retain wedges 120, FIG. 12, which are set to the angle of the wedges and are welded to the upright legs of frame 117. The wedges press plates 48 firmly against the outer projecting legs of the angle iron members of frame 117 and can be set and removed quickly. The perimeters of plates 48 are bolted to the top annular angle iron flange of chamber 21. Channel rubber 121 detailed in FIG. 11 is a commercial product and is used to seal the chamber assembly against base plate 56 to prevent the escape of crusher dust. FIG. 9 is a vertical cross sectioned view through the chamber assembly showing containment ring 102 with wear resistant plate 116 resting on the top edges of vanes 115; it also shows wedges 120 in place.

Figure 14:
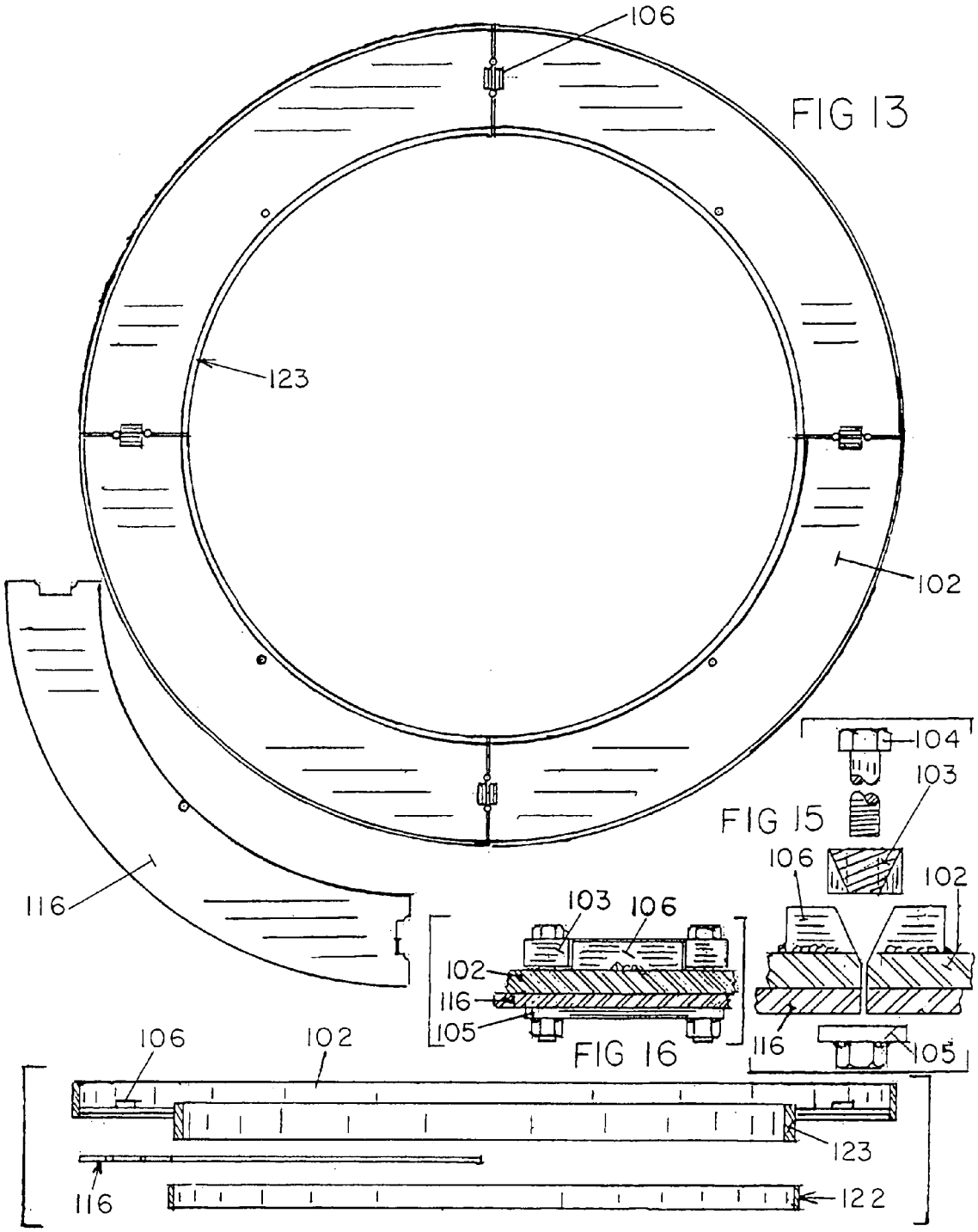
FIG. 14 is an exploded, vertical sectional view through the ring arrangement of FIG. 13.

FIG. 13 is a plan view of containment ring 102 and one of its wear plates 116, and an inner segmented ring 123 is welded to arcuated sectors 102. FIG. 14 is an exploded vertical sectioned view of sectors 102, and wear ring 122 fits over the depending portion of ring 123 and becomes secured in position when sector 102 is expanded by wedges as in FIG. 16. plates 116 have at least one bolt to hold each to sector 102 until they rest on vanes 115.

FIG. 15 is a vertical exploded view of the wedging assembly, and FIG. 16 shows a side on vertical view of a finished assembly. The purpose of this expandable member is protect the top cover from abrasion of flying rock, and its wedge design makes a quick way to install and replace, and a tight fit against the chamber wall holds it securely in place.

Figure 17:
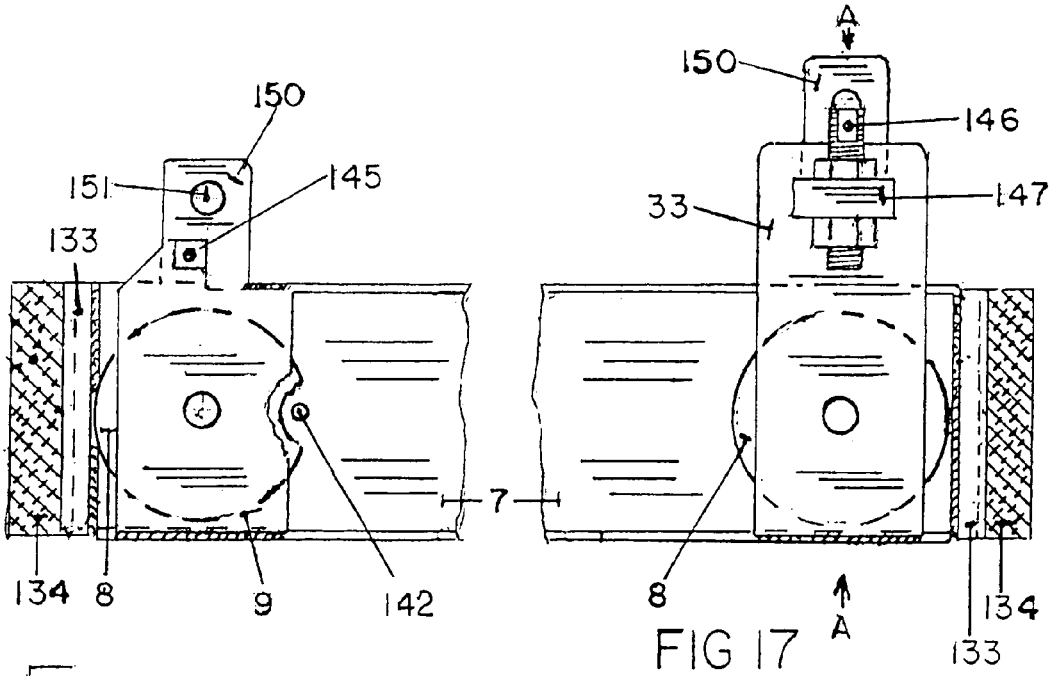
FIG. 17 is a foreshortened, sectional side elevational view of the elevator frame.

FIG. 17 is a detailed vertical sectioned view of one side of the elevator frame; the other side is a mirror image. Plate 9 is configured to partially overlap the lower flange of I beam 7 to provide parallelism to the web of the beam, maximum space for rollers 8, and to provide for a strong fillet weld. Its top extension provides an anchor attachment 145 for a roller chain connecting link and a partial fillet weld space as below. Plate 33 extends higher than plate 9 and is slotted to allow adjusting means 146 in horizontal beam 147 to extend the same distance beyond anchor attachment 145 as the space between double chain sprockets 12. A threaded member 146 has flats milled to the width of a chain link and a hole drilled to the size of a chain pin; a jam nut above beam 147 and a full thickness nut be low provide for adjusting chains for parallel lifting and full seating of seals 121 against base plate 56.

Upstanding members 150 are drilled at points 151 to receive pins 152 for hooks 10, and the angles $\alpha$ are to facilitate engagement of hooks when the elevator is raised to working position. Angle irons 133 have low friction slide-way material 134 bonded to their projecting legs. A threaded hole 142 receives cap screw 141, FIG. 18.

Figure 18:
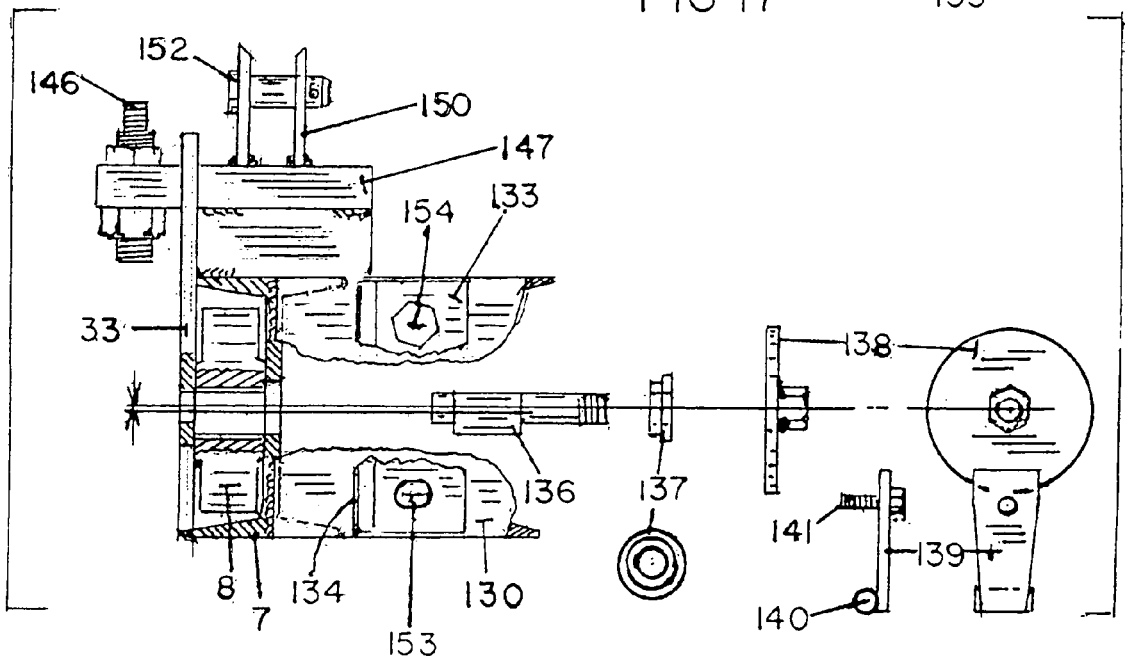
FIG. 18 is an exploded end elevational view of the assembly of FIG. 17 as viewed from the right in FIG. 17.

FIG. 18 is an exploded view at right angle to beams 7, and channel iron crossbeams 130 are welded to the ends of I beams 7 to form a rectangular frame. Four rollers 8 are journalled on cam axles 136 which pivot in plates 9 and 33 at axles outer ends and within bushings 137 which seat in the I beam's web and allow cams of axles 136 to be assembled through enlarged holes in beam's web. Bushing 137 follow cams and journal cams concentric to bearing holes in members 9 and 33. Cam axles are rotated by turning discs 138 with a wrench on the nuts welded to each disc 138. The nuts are locked to each axle with anaerobic thread locking fluid which bonds strong enough to turn cams but can be broken free to separate parts if needed to repair.

Cam axles are rotated to bring rollers to lightly touch uprights 4, and third class levers 139 have fulcrum on bars 140 welded to their extreme ends and are clamped to discs 138 by cap screws 141. The cam axles are locked from rotating thereby retaining their adjusted positions. Angles 133 having the low friction slide material bonded to one leg can be adjusted horizontally by elongated slots 153 sliding over and retained by bolts 154. Not shown are polished steel guides welded to insides of the flanges of columns 4 for material 134 to slide against. This construction forms a guided elevator frame. This design provides stability to the entire elevator assembly and resists the impacting forces of impinging rock attempting to rotate the rock chamber.

FIG. 19 is a vertical sectioned view of the main rotating mechanism. Driven sheave 50 is of two piece fabricated steel construction to attain required strength, low cost of manufacture, and minimum replacement costs. Annular rim 50 is rolled steel plate welded at closure of the roll, stress relieved, and fully machined. An internal thread 162 is cut to a shoulder; and plate member 163 is fully machined and threaded into sheave 50 using an anaerobic thread locking fluid to firmly seat against said shoulder. The hand of thread is in the direction that the driving forces will tend to tighten the thread against said shoulder.

The cup shaped construction of sheave 50 is to achieve balanced belt pull applied to bearing 165. Multiple cap screws 164 join sheave 50 to hollow spindle 51 and is centered to spindle 51 at diameters 52. Labyrinth seal 192 is retained to sheave 50 by a slight positive angled taper having an interference fit and is assembled by either expanding the open end of sheave 50 with heat or contracting seal 192 by cooling. A thick walled tube 51 or pipe has an internal diameter large enough to have adequate running clearances around a depending tube 73 and an outer diameter large enough to provide machining to accept a stock size anti-friction bearing 165, along with a first shoulder diameter for ring 186 positioned between the bearing and first shoulder; plus a second shoulder for positioning seal 191.

Ring 186 has a band 187 secured to it and band 188 which is secured to member 169 ring form a deep labyrinth seal. In addition to first and second shoulders diameters are added larger diameters 197 and thread diameter 198. The bore of tube or spindle 51 is slightly tapered outward above and below the midline of bearing 165 to accommodate any wobbling of the spindle. Wobbling can be caused by unbalanced forces within impeller 60.

Figure 20:
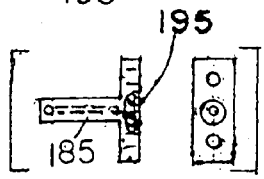
FIG. 20 is a vertical sectional view of a lube oil injection nozzle.

Conical ring 183 has a flange for cap screw attachment to housing 167 and serves as a lube oil retainer, and annular nut 166 clamps bearing 165 between it and ring 186 and enables said bearing to carry the weight of all depending members. Only a ball bearing will cope with the very high speeds required plus thrust loading in both directions, and moment loading caused by an out of balance rotor. In well balanced operations the thrust loading of this bearing is very light, and it has a long life potential. However, the high ball speeds require a special oil that must be applied by spray injection above and below the rolling balls. This oil is conducted by hydraulic hoses, not shown, from pump 83 to inlets 178 and 179. Drilled passage ways conduct oil from inlet 178 to nozzle 185 (detailed in FIG. 20) that is retained by cap screws against a flat surface milled in housing 167.

An elastomer seal ring 195 prevents oil leakage between nozzle and housing. The oil sprays upward, and an opposed oil passage from inlet 179 conducts oil into bearing clamping ring 168 which is drilled to conduct oil to spray onto balls from above. The flanged conical member 183 diverts oil that may be ejected above the bearing to fall back and through the bearing and to prevent any oil to escape between sheave 50 and housing 167. Housing 167 is either formed from a rolled and welded band or flame cut from a thick plate. The housing is machined to retain bearing 165, threaded to receive member 169, which is permanently bonded to housing 167 and has a conical diverging bore for oil drains 182. An annular plate 171 is sufficiently thick to shoulder into housing 167. It has a boss to retain labyrinth seal 193 have oil passages 178 and 179, and receive member 172 recessed into it.

The ID (inside diameter) of member 171 is configured to retain seal 189 and has small cap screws to retain said seal and with space above for clearance for the heads of said screws without interference from member 169. An annular flat ring 172 has an OD (outside diameter) to fit into member 171 and an ID projecting inward past a flexible member 173 far enough for cap screw attachment to inlet 179 but slightly larger than seal 189. Member 174 is a ring fully welded to annular plate 175; its ID is machined to fit boss 176 of base plate member 56, and its OD is as flame cut. The inside surface of member 174 is machined conical and the top surface of 175 is prepared for bonding as is the under side of member 172. These three members are bonded to a low durometer elastomer 173 that is oil and atmosphere resistant. Some additional molding parts are used in the molding process to contain the elastomer but are treated to prevent being bonded and are removed after bonding and curing are completed. This mechanism absorbs all but the most severe wobbling and protects companion parts from damage.

A cylindrical area with two or more pair of recessed holes 194; each pair of recessed holes are 180° apart. Two or more evenly spaced conical sectors 180 have cylindrical sectors between that are slightly longer in arc than the conical sectors and are the male elements of our gunlock connection. Partially threaded studs 181 with one or more tangental flats are inserted into threaded holes at the trailing end of said conical sectors 180 and with a tangental flat parallel to those ends. Thread 193 and nut 58 retain impeller 60. A conical seating means 79 centers telescoping member 78 to static member 77.

Figures 21, 22, 23:
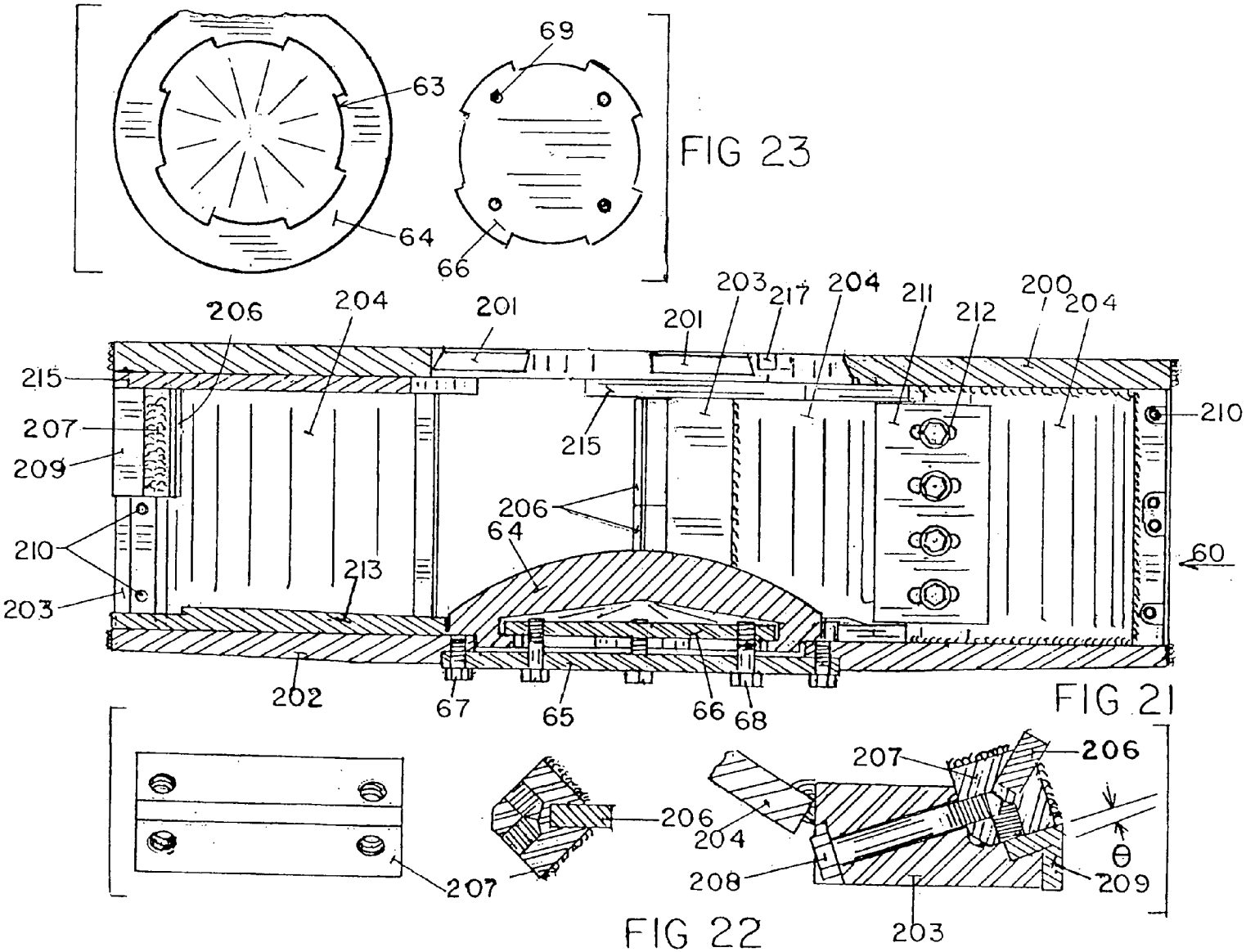
FIG. 21 is a vertical sectioned view of an impeller.
FIG. 22 shows the back view, cross-section view, and a sectioned view of a wear tip clamped in working position.
FIG. 23 is a bottom plan view of an arrangement for retaining the distributor plate.

FIG. 21 is a vertical sectioned view of an impeller also called a rotor. Discs 200 and 202 are crossrolled steel plates for stronger uniform tensile strength across their annular shape to form discs having adequate strength to withstand the very high stresses of centrifugal forces imposed upon them. Top disc 200 is thick enough for our gunlock design having inward projecting conical sectors 201 that cooperate with the sectors 180, FIG. 19. The cylinderical arc length between each sector 201 is slightly longer than the arc lengths of conical sectors 180 so as to allow engagement of the gunlock members. Studs 181 prevent the gun lock from disengagement in the trailing direction by engaging conical sector 201. The gunlock sectors are tapered so that a tight and firm connection can be achieved when nut 58 is fully tightened, and yet release freely when nut is turned open. To prevent the rotor from unlocking in the opposed rotation, radial slots 217 are machined into disc 200, and their function will be explained later.

Our gunlock design is much faster and easier to change impellers than other VSI crushers that use a solid shaft with a top end long taper and a matching taper in a hub attached to the single disk of their impeller which is retained by a thick nut that must be fully removed plus the risk of a stuck taper. Discs 200 and 202 are spaced apart by arcuated members 204 and rectangular members 203 all of which are firmly joined by welds; two or more of sets of members 203 and 204 are used, and usually three or five. The production capacity of a crusher of this type is dependent on the number of said sets, their vertical length, and available horsepower.

The openings between members 203 are called "ports." The abrasion rate within an impeller is huge and must be accomodated with easily installed wear resistant members; the most rapid wear is at the tip 206. Many different concepts of rotors and their impelling means have been tried since VSI crushers first appeared in the 1950's. The average impeller "shoe" only lasts a few hours as do the static breaker bars that received the impact of propelled rock. The shoes develop valleys and the anvils wear to a cup shape; crushing efficiency diminishes and these two parts rarely use more than 10% of their weight before being replaced.

Our new design is detailed in FIG. 22. A carbide insert is retained in a machined slot in a square steel member 207, two faces of which are drilled and threaded. Four cap screws are used to hold member 207 in a welding and machining fixture. Two faces of member 207 adjacent to area to be slotted are hardfaced with weld metal while being held in said fixture to restrain member 207 from being warped by the welding. The welds stop just short of area to be slotted because the hardface weld metal cannot be machined. The carbide insert is secured in the slot with a high strength anaerobic means.

Figure 25:
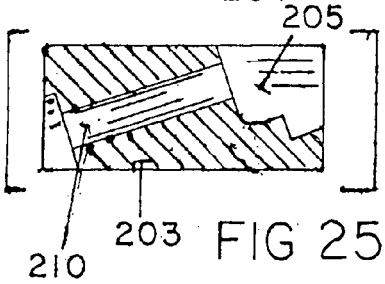
FIG. 25 is a cross-sectioned elevational view of a tip holding member.

Steel member 207 is retained by cap screws 208 through holes 210 in member 203 having a machined seating means 205, (FIG. 25). The rock spill over the tip causes extreme wear conditions as it exits. Accordingly, a wear member 209 protects member 203. This member is also carbide, and is simultaneously retained with member 207 by converging angle θ and its inner vee shape. To achieve maximum tip life tip holder 207 can be turned end for end to use its other set of threaded holes and also be moved vertically to switch positions with its companion because there are two equal length tips in each recess 205. Each tip can be used in four different positions, although the lower tip gets the most wear.

Wear plate member 213 is subject to sliding wear and is best made from high chrome chilled iron, but other metals can be used but will wear faster. Upper plate 215 usually lasts a long time and can be flame cut from abrasion resistant steel plate. Member 211 is designed to be positioned radially inward or outward and is clamped in set position by bolts 212. The purpose of this member is to control the depth of rock bed as it lays against members 204 and tip 206 and also to prevent spill over at the trailing edges of members 204. Distributor member 64 is cast of abrasion resistant metal and is annular in shape as shown in FIG. 23 a bottom view. Inward projecting sectored means 63 are spaced apart to allow outward projecting means of mild steel plate 66 to be assembled into clamp member 64 and rotated over 63 to enable cover plate 65 retained with cap screws 67, and cap screws 68 threaded into plate 66 clamp member 64 in operating position. Annular member 64 can be installed through the gunlock opening or through a port in some rotors.

Figure 24:
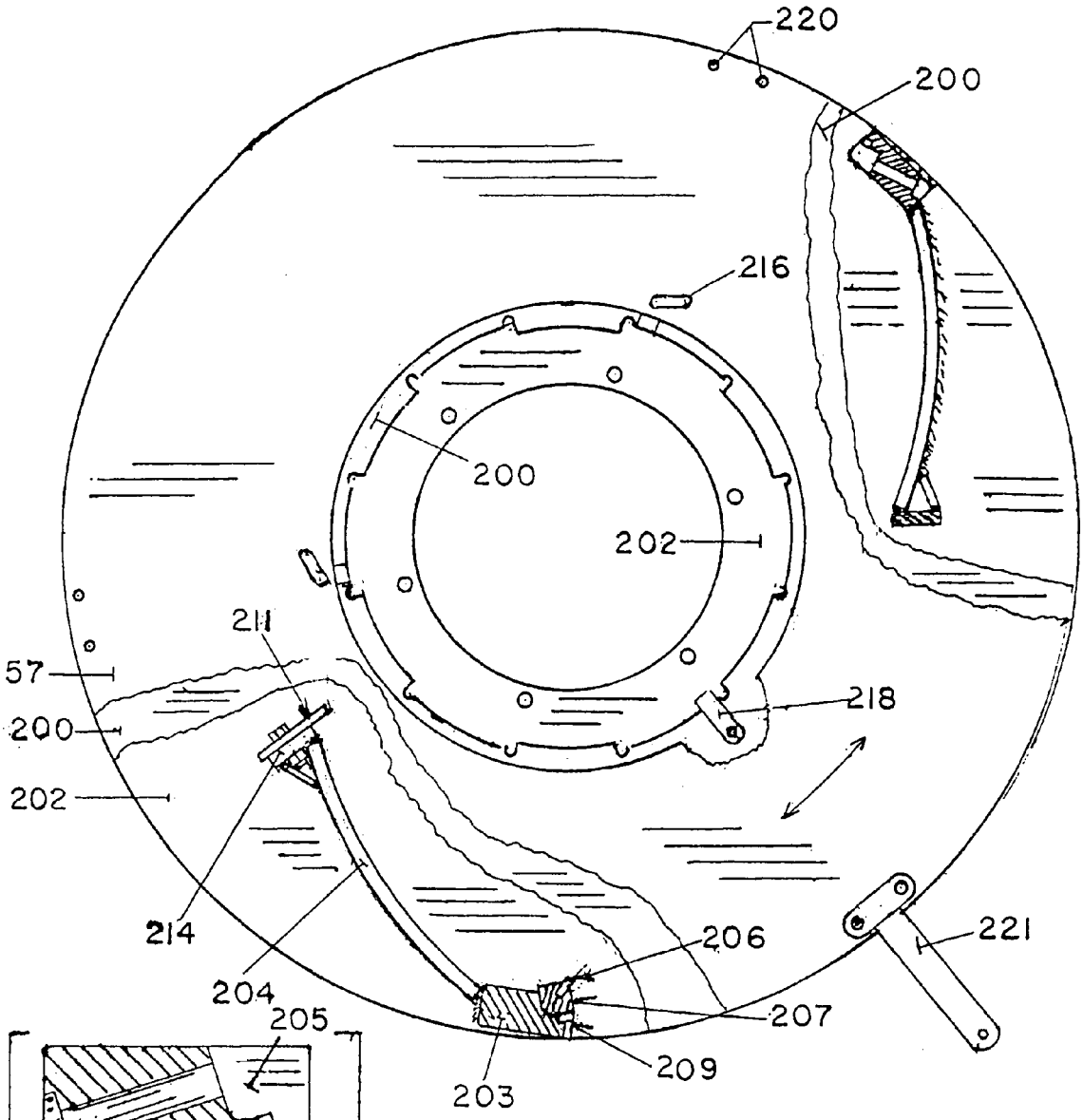
FIG. 24 is a plan view of the top face of an impeller, parts being broken away and sectioned to show its associated parts otherwise hidden from view.
Figure 26:
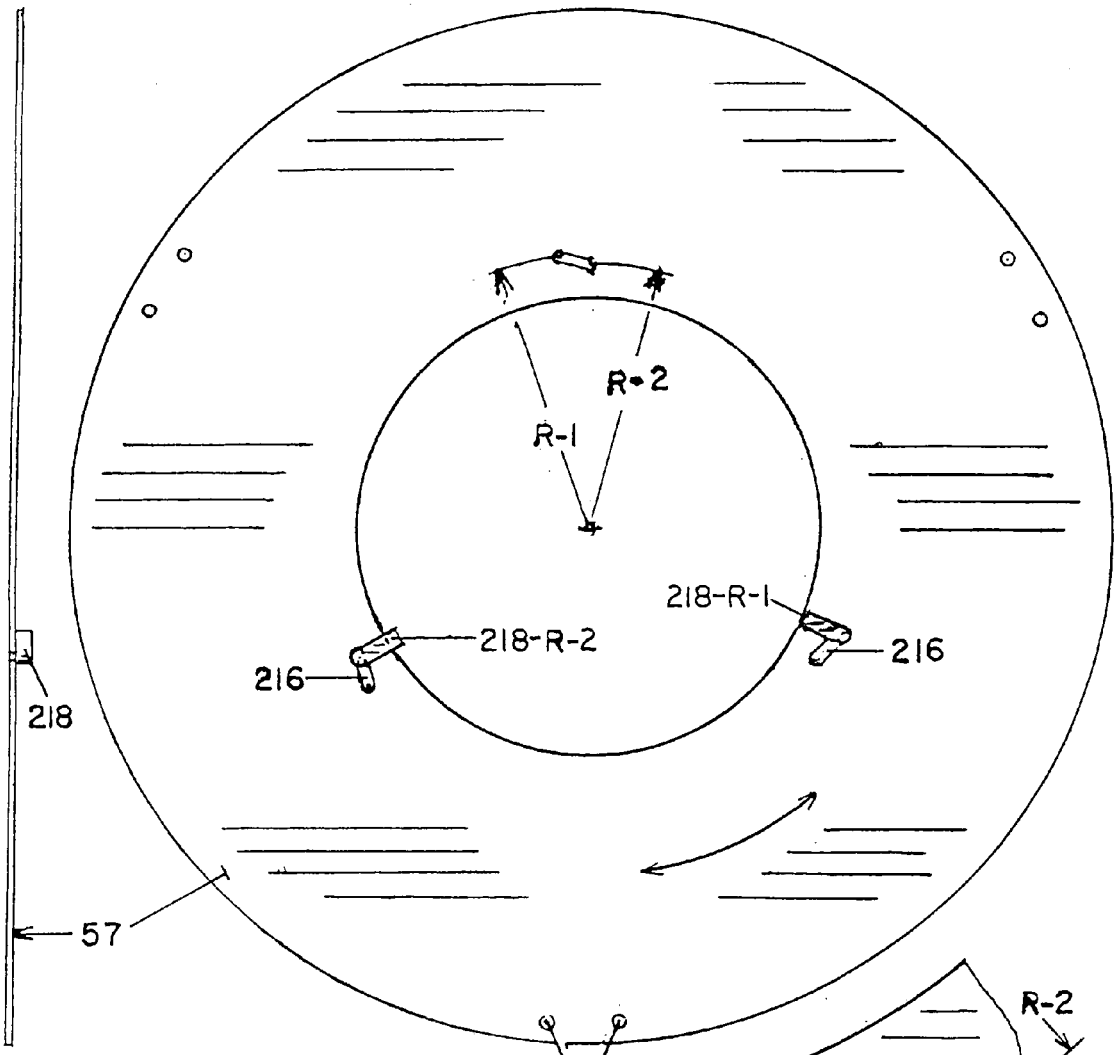
FIG. 26 is a plan and corresponding edge view of a combination wear and camming disk.
Figure 27:
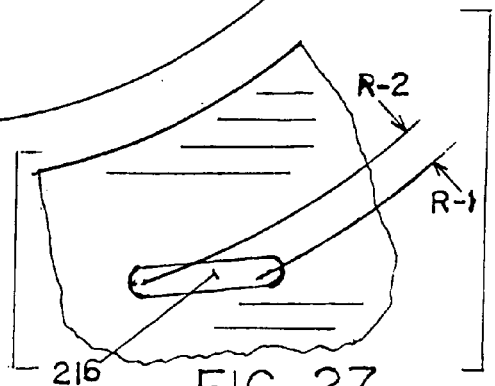
FIG. 27 is a fragmentary plan view of a cam slot.

FIG. 24 is a partially sectioned plan view of an impeller top protector wear disc 57 made of wear resistant steel plate machinable with carbide tooling; it has three or more camming slots 216, shown in FIGS. 26 and 27. When an impeller is installed to a spindle member, member 57 is rotated with a pin wrench 221 to retract slide bars 218 to maximum outward positions. Gear nut 58 is turned to a light contact with member 57. When an impeller is positioned against stops 181, disc member 57 is rotated in the direction that cam slots engaged by pins 219 push slide bars inward. This action captures conical sectors 201 between stops 181 and slide bars 218. The thread of geared nut 58 is of the hand will tighten in the direction that tends to turn disc member 57 to push bars 218 inward relative to the rotation of the spindle. The functions of other members numbered have previously been explained.

Figure 28:
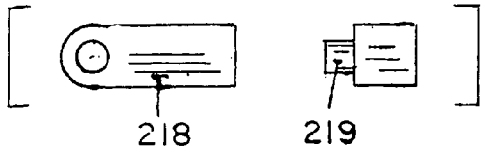
FIG. 28 is a side elevational view of a sliding bar member driven by said cam slot.

FIGS. 26 and 27 show radii R-1 and R-2. FIG. 26 shows slide bar 218 in R-2 and R-1 position. FIG. 28 details slide bar 218 and pin 219 which projects above bars 218 the thickness of member 57 or slightly less.

Figures 29, 30, 31:
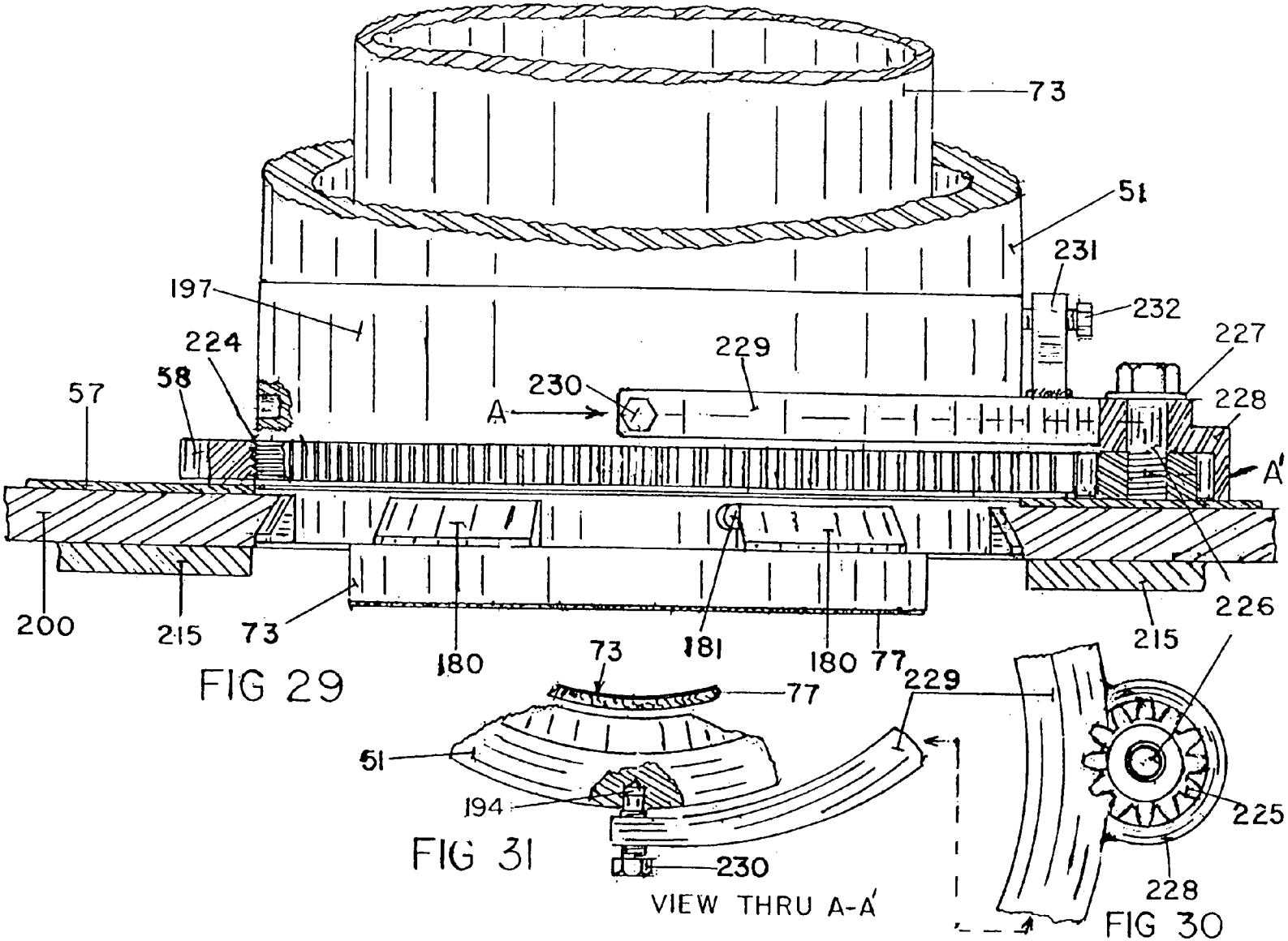
FIG. 29 is a fragmentary vertical elevational view of an arrangement to turn a large ring like nut by gear apparatus.
FIG. 30 is a plan view of a driving gear within a housing joined to a yoke.
FIG. 31 is a fragmentary plan view showing the connection of the yoke to a spindle.

FIGS. 29,30, 31 show the construction and use of the means of turning gear nut 58. A 180° yoke 229 is slightly larger in inside radius than the radius of cylindrical portion 197 of spindle 51. Section 197 has recessed holes 194 that are engaged by screws 230 which have a portion of their threads removed. This locks the spindle relative to small gear 225, and screw 232 is positioned against the spindle to restrain the yoke from rising as gear 225 is turned, as by a wrench having a handle length long enough to apply adequate torque is set on the head of screw 226. Screw 226 is bonded to gear 225 with a very high shear strength anaerobic thread locker.

Washer 227 is a flat washer, and the outside diameter of teeth of gear 225 is slightly less than the inside diameters of housing 228 so that the reactive force of turning gear 58 is absorbed by the housing rather than by screw 226. The edges of the teeth of gear 225 are rounded to prevent cutting the bore of housing 228. Holes 194 must be exactly 180° apart to insure proper gear meshing. The housing 228 is welded to yoke 229. Prior to this design we used two long spanner wrenches that required two workmen and the wrenches were difficult and awkward to use.

Figure 32:
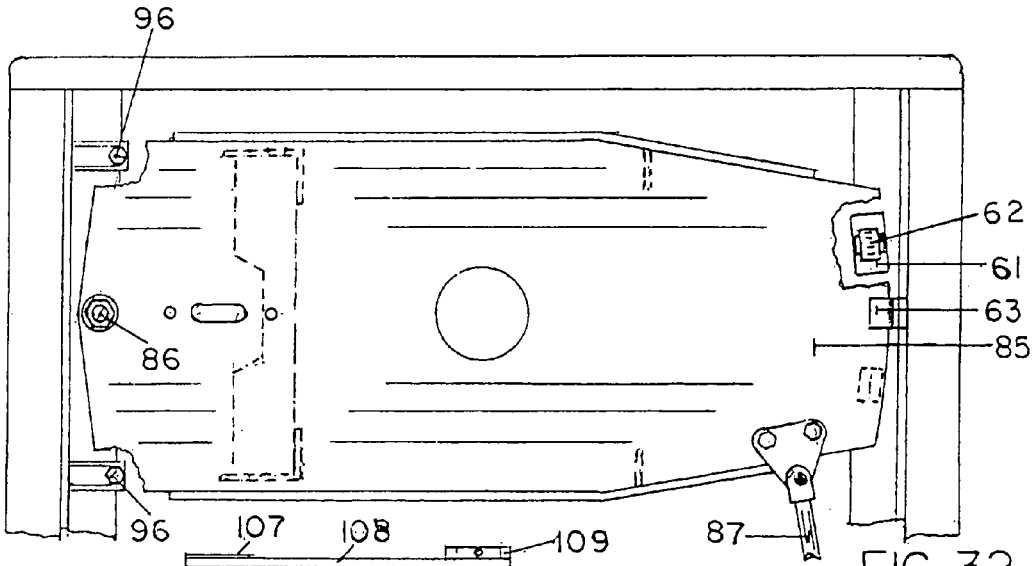
FIG. 32 is a plan view of a swingable motor base.

FIG. 32 is a plan view of a motor base as used in our VSIC. Flate plate 85 is reinforced by flat bars set edgewise under its longitudinal edges, and plate 85 pivots on member 86 and is stabilized against tipping forces that motor torque applies by means 96 which is detailed in FIG. 34. The opposed end of plate 85 is arcuated with pivot member 86 being the center of the arc. Roller means 62 support plate 85 in a level position and minimize frictional resistance to push-pull swinging of plate 85 by power means 87.

Figure 33:
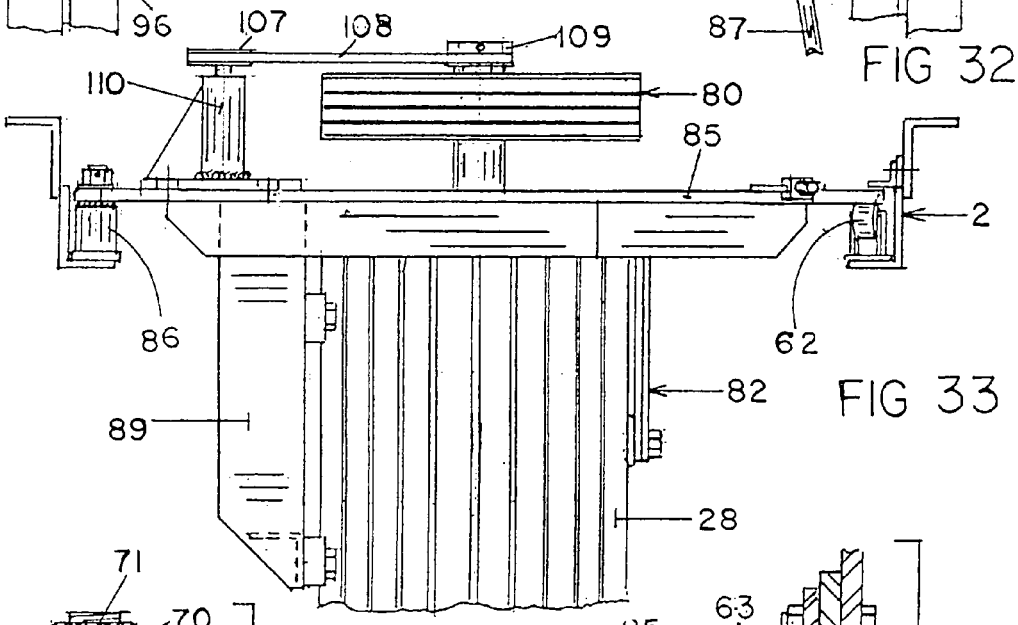
FIG. 33 is a fragmentary vertical view of the motor base of FIG. 32.

FIG. 33 is a vertical view of plate 85 including a section of a motor 28 and drive sheave 80. Pulley 107, belt 108, and pulley 109 are an auxiliary drive to lubricating oil pump 83 as previously described. A bearing housing assembly 110 contains two spaced apart antifriction bearings with a shaft journalled in said bearing and driven by sheaves 109 and 107 and belt 108. The shaft projects below plate 85 and is coupled to an overrunning clutch, universal joints, and a slip shaft as shown in FIG. 1 with drive shaft assembly 34. Depending angle iron members 89 are welded to plate 85 to provided attaching foot mounted motors, their distance from center being determined by the frame and size of motors used. Means 82 are flat steel bars attached to brackets welded to plate 85 and a lifting hole that all large motors have; their purpose is to help support the weight of the motor.

Figure 34:
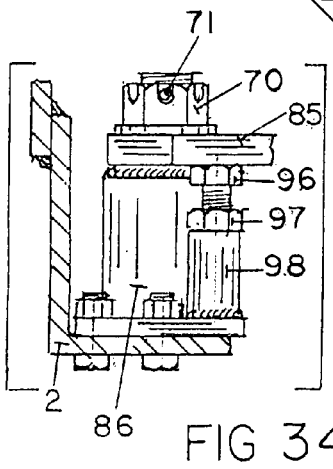
FIG. 34 is a fragmentary vertical elevation of the the pivot arrangement and stabilizers means for the motor base of FIGS. 32 and 33.

FIG. 34 shows one of two upright members 98 welded to base plates and bolted to beam 2, each having an internal thread into which cap screw 96 is inserted. The top faces of screw 96 are polished to remove any stampings. At assembly each are adjusted to light contact against plate 85, and then jam nuts 97 are tightened. Also shown in FIG. 34 is a partially obstructed view of pivot 86 which is an upright tubular member with an insert at its top and welded to it. This insert is machined to fit the inside diameter of pivot 86 and the diameter of pivot hole in plate 85 and threaded to receive castle nut 70 which is adjusted to barely allow free pivoting of plate 85 and is then locked with a cotter pin 71.

Figure 35:
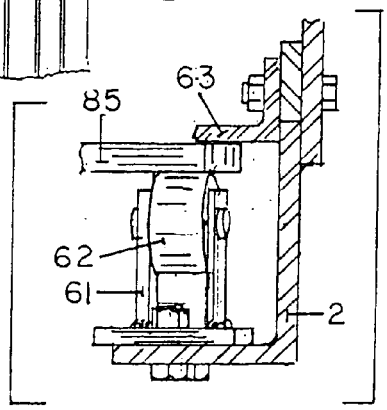
FIG. 35 is a fragmentary vertical elevational view of the roller apparatus supporting said motor base opposite said pivot means.

FIG. 35 shows one of two roller assemblies 62 journalled in support frame 61 and in contact with plate 85 to support plate 85 in a level position. A bracket 63 is set to slight clearance above plate 85 to prevent a complete assembly of all components of bases 85, motor, and drive from bouncing on the rollers when the machine is being transported.

Figure 36:
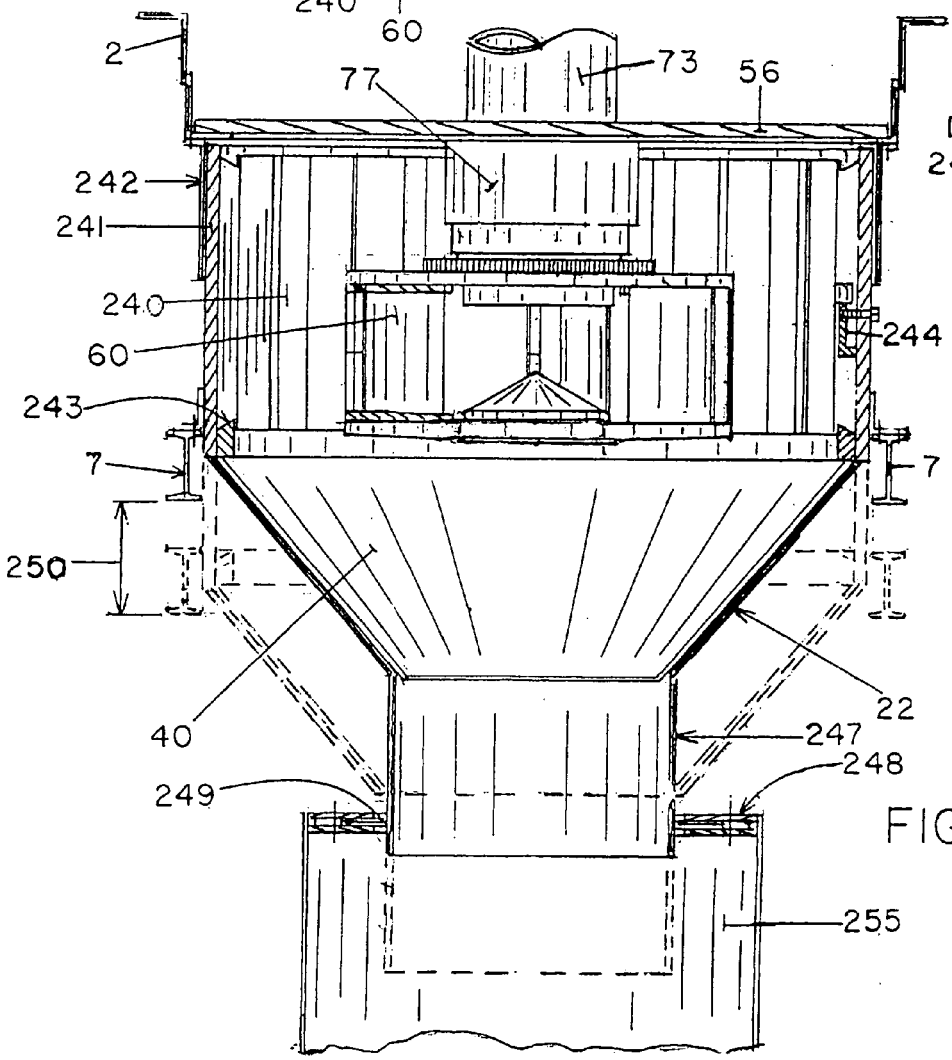
FIG. 36 is a fragmentary, vertical sectional view showing a an arrangement for rock crushing against impact anvils instead of rock on rock crushing.

FIG. 36 is a vertical sectioned view of an insertable arrangement for converting our invention from crushing rock on rock to crushing against metal anvils. Wall 241 is an annular steel wall of adequate thickness to support breaker anvils set on a conical member 243. Means 244 and cap screws 245, FIG. 39, hold each anvil against said wall. A band 242 with slight clearance gap 246 encircles wall 241. The assembly sets on the elevator frame, and essentially the same impeller is used but might have larger vertical ports. The anvils are about twice as long vertically as port depth of the impeller. The elevator is adapted to move down and up slowly and pause at each end of travel. This evens the wear on the anvils and will greatly prolong their useful life, maintain efficient crushing, and minimizing throwaway metal by preventing cupping wear as occurs in the immovable anvils of other vertical shaft impact crushers. To avoid dust escaping a close fitting seal encircles cylindrical extension 247 built into hopper 255, and a vacuum air pump draws away dust escaping at gap 246.

Figure 37:
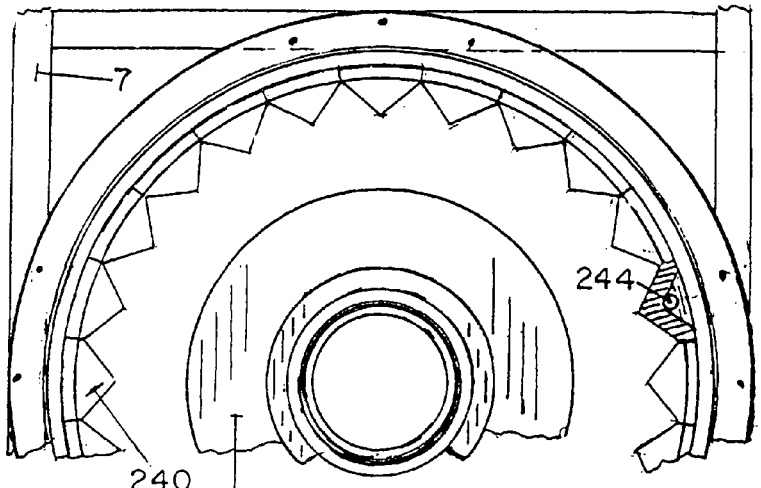
FIG. 37 is a fragmented plan view of one form of several possible shapes of impact anvils and an arrangement for their containment.
Figure 38:
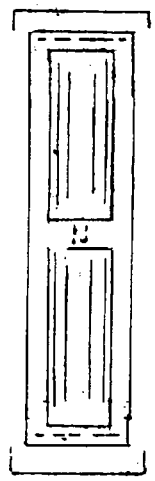
FIG. 38 is a rear elevational view of an impact anvil.
Figure 39:
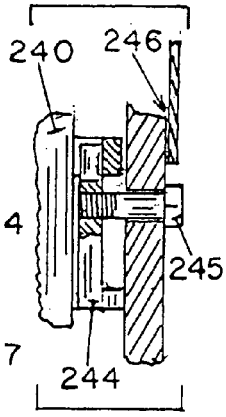
FIG. 39 is a fragmentary vertical sectional view of an arrangement for holding anvils against its containing annular wall.

FIG. 37 is a plan view of one of several different designs possible for anvils; FIG. 38 shows the back side of an anvil showing recesses to save weight and casting costs. FIG. 39 details one method of retaining anvils in working position. Member 244 is a third class lever fulcruming at its lower end against wall 241 and its top end bearing within a hole cast in a central web of anvil 240, and the cap screw 245 pulls member 244 outward.

From the foregoing carefully detailed identification and description of the various structures and structural elements and parts of a preferred embodiment of the rock and ore crusher apparatus of this invention, it will be apparent to those skilled in the art that the invention provides a suspended-impeller crusher apparatus in which a rock ejecting impeller member is secured onto the bottom end of a vertically-suspended, rotating, hollow drive shaft, identified herein as a hollow drive spindle. This impeller-supporting spindle member is open through its opposite terminal ends, its hollow interior communicating through its open top end with a feed hopper and through its bottom open end with the interior of the impeller member, for passage of rock and ore material to be crushed from the hopper through the hollow, rotating spindle and to the impeller. Preferably a protective, stationary, static tube 73 is provided to extend through the hollow confines of the rotating spindle to conduct rock material from the hooper to the impeller while isolating the rock material from damaging and wearing contact with the interior surface of the rotating spindle, as seen in FIG. 2. Of course, rock and ore is then ejected from the rotating impeller at high speed, for shattering impact within an encircling annular rock impact chamber surrounding the impeller member. Crushed rock product then falls from the annular chamber and enters a discharge hopper apparatus for discharge from the crusher as finished product.

This invention also provides that the impeller-encircling annular chamber, in the preferred embodiment of the invention, may be supported on an elevator frame mounted for vertical movement on the main frame of the crusher apparatus, for vertical movement of the annular chamber between a first, operative, impeller-encircling position for operation of the crusher apparatus, and a second, maintenance position in which the elevator is moved to move the supported annular chamber vertically out of impeller-encircling position. This allows repair personnel unhindered access to the impeller and drive spindle assemblies and to the interior of the annular chamber for facilitated inspection, servicing and replacement of parts, including the entire impeller as a single member, for minimal down-time of the machine for maintenance. This vertically-movable annular rock chamber construction also allows, as has been previously described, for automated operation and control of the elevator drive mechanism to move the chamber slowly upwardly and downwardly within a predetermined range during operation of the crusher apparatus in order to vertically even out the wear against the interior surfaces of the chamber resulting from the impacting of rock and or material ejected from the rotating impeller during operation of the crusher.

There is also disclosed a quick release and attachment mounting connection arrangement, referred to as a gunlock type connection in the particular embodiment illustrated, for releasably securing the impeller onto the bottom end of the drive spindle. This further assists in the facilitation of maintenance operations and reduced downtime of the crusher apparatus.

The suspended impeller construction of the present invention also allows for the provision of a swingable servicing boom member 35, 36 mounted on the main frame and arranged to be operable for engaging, supporting and carrying an impeller member during installation and removal maintenance operations, as explained in connection with FIGS. 3 and 6 of the drawings.

From the foregoing it will be readily apparent to those skilled in the art that many changes, other than those already discussed, may be made in the size, shape, type, number and arrangement of parts and structures shown and described hereinbefore without departing from the spirit of this invention and the scope of the appended claims.

Having thus described our invention and the manner in which it operates, we claim:

1. A rock and ore crusher apparatus having a suspended impeller, the crusher apparatus comprising:

a) a supporting main frame structure, b) a substantially hollow impeller support spindle having opposite terminal ends, the interior confines of the hollow spindle open through said opposite terminal ends, c) a support bearing apparatus on said main frame arranged to supportingly engage said spindle for rotation of the spindle in substantially vertically-suspended condition supported on said main frame, the opposite terminal ends of the spindle identifying respective vertical top and bottom ends of the vertically-suspended spindle supported rotatably on the main frame, d) power drive means on said main frame for engaging said spindle to rotate the spindle supported in vertically-suspended condition on the main frame by said support bearing apparatus, e) a rock and ore impeller mounted on the vertical bottom end of the suspended spindle for rotation therewith, the interior confines of the hollow spindle open to the impeller through the bottom end of the spindle, f) a hopper supported on the main frame and arranged to receive rock and ore material to be crushed, said hopper further arranged to communicate rock and ore material from the hopper into the hollow interior confines of the vertically-suspended, rotatable spindle through the vertical open top end thereof, for passage of rock and ore material through the hollow spindle to said impeller during powered rotation of the spindle and impeller mounted thereon, g) an annular rock impact chamber supported on said main frame structure and arranged to freely encircle said impeller, said annular chamber arranged to receive rock and ore material ejected from the rotating impeller in material-shattering impact within the encircling annular chamber, and h) crushed material discharge means for communicating with said annular chamber and receiving crushed material falling from the annular chamber after impact therein and for discharging the material from the crusher apparatus, i) whereby with the power drive means operating to rotate said spindle and impeller at a selected speed of rotation, rock and ore material to be crushed may fall from the hopper vertically through the interior of the vertically suspended, rotating, hollow spindle to the rotating impeller whereupon the material is ejected outwardly from the impeller and into violent, crushing impact within the impeller-encircling annular chamber, the impacted material then falling by gravity from the annular chamber for discharge from the crusher apparatus.

2. The crusher apparatus of claim 1 wherein said main frame structure supports a vertically movable elevator frame and said annular chamber is supported on said vertically movable elevator frame, and power drive means interengages said main frame and elevator frame for selectively moving the elevator frame and supported annular chamber vertically on the main frame between a first, operative position in which the annular chamber is positioned to encircle said impeller for operation of the crusher apparatus, and a second, vertically-displaced, maintenance position in which the annular chamber is positioned out of impeller-encircling condition for inspection, servicing and replacement of the impeller.

3. The crusher apparatus of claim 2 wherein said impeller and bottom end of said spindle respectively mount a one of first and second corresponding interengaging connector members of a quick attach and release lock connector apparatus, the connector apparatus arranged for selected relative movement of said first and second connector members into and out of interengagement with one another for mounting connection and separation, respectively, of the impeller and the spindle.

4. The crusher apparatus of claim 2 including a swingable, impeller support boom pivotally supported on the main frame for pivotal movement on the main frame, when the annular chamber is disposed in said second, maintenance position, into a position beneath said impeller and operable to engage and support the weight of the impeller and pivotally carry a supported impeller out of the confines of the crusher apparatus for facilitated servicing and replacement of impellers.

5. The crusher apparatus of claim 1 including a substantially hollow rock and ore material-confining static tube, open through its opposite terminal ends, supported on the main frame for substantially free extension through the hollow interior confines of the rotatable spindle, one open end of said tube communicating with said hopper and the opposite open end of said tube communicating with said impeller for passage of rock and ore material from the hopper to the impeller member through the hollow confines of the static tube.

6. The crusher apparatus of claim 1 wherein said support bearing apparatus comprises a single anti-friction bearing assembly contained with an annular enclosure supported on the main frame by interengaging, flexible mount apparatus arranged to absorb vibration and wobbling of the rotating spindle during rock and ore crushing operation of the crusher apparatus.

7. The crusher apparatus of claim 1 wherein said power drive means includes a pair of drive motors supported on said main frame in substantially opposing position one to the other with the vertically-suspended spindle disposed therebetween, each said drive motor drivingly engaging a spindle-engaging drive belt arranged to rotate the spindle upon operation of said drive motors, and belt tensioning means for tensioning each said drive belt during operation of the crusher apparatus.

* * * * *